United States Patent [19]

Charles

[11] 4,147,471

[45] Apr. 3, 1979

[54] AUTOMOTIVE COOLING FAN WITH BIASED FLEXIBLE BLADES

[75] Inventor: Herbert N. Charles, Chatham, Canada

[73] Assignee: Fram Corporation, East Providence, R.I.

[21] Appl. No.: 843,564

[22] Filed: Oct. 19, 1977

[51] Int. Cl.[2] ..... F04D 29/38

[52] U.S. Cl. ..... 416/132 A; 416/240; 416/DIG. 3

[58] Field of Search ..... 416/132 A, 132 R, 240, 416/DIG. 3

[56] References Cited

U.S. PATENT DOCUMENTS

| | | | |
|---|---|---|---|
| 3,679,321 | 7/1972 | Strick | 416/132 A |
| 3,773,435 | 11/1973 | Wooden | 416/240 X |
| 3,836,284 | 9/1974 | DeJong | 416/132 A |
| 3,910,718 | 10/1975 | MacEwen et al. | 416/240 |
| 4,012,168 | 3/1977 | Spellman | 416/132 A |

FOREIGN PATENT DOCUMENTS

| | | | |
|---|---|---|---|
| 962244 | 2/1975 | Canada | 416/132 |

*Primary Examiner*—Everette A. Powell, Jr.

[57] ABSTRACT

A flexible bladed automotive cooling fan comprising biasing members biasing both the upstream and downstream sides of th blades including a root portion of the upstream biasing member extending beyond the remainder of both biasing members, the blade thereby having a substantially increased natural frequency and a reduced amplitude of vibration at resonance as well as an improved airfoil configuration.

7 Claims, 5 Drawing Figures

FIG 1
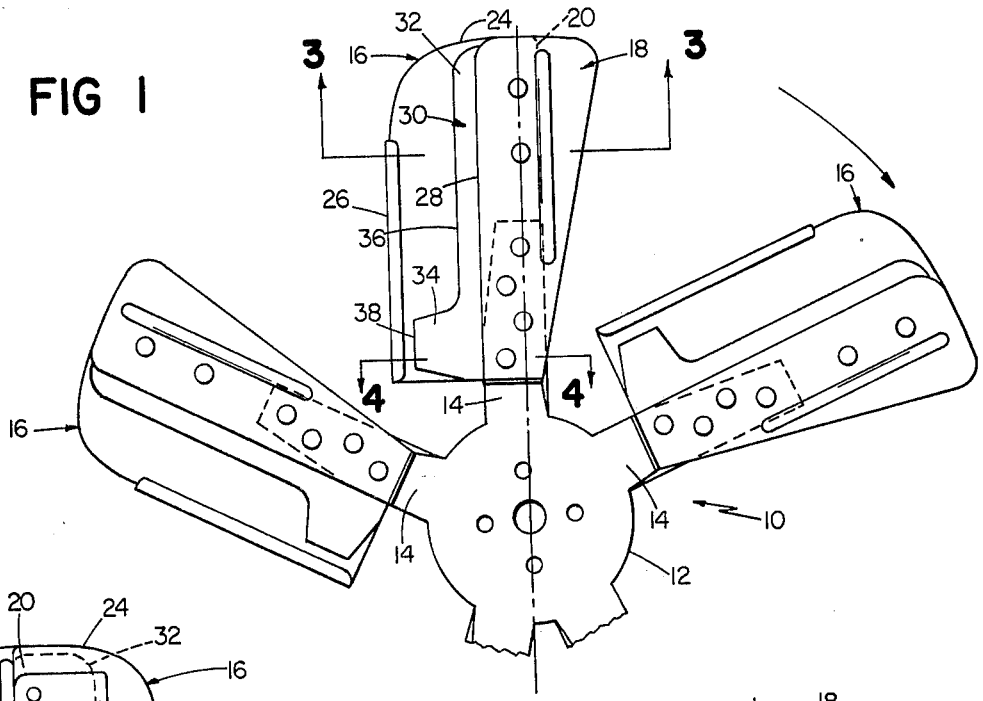
FIG 2
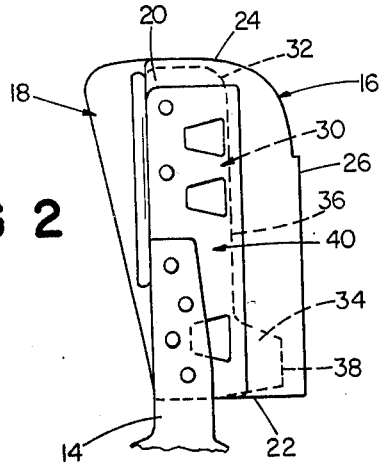
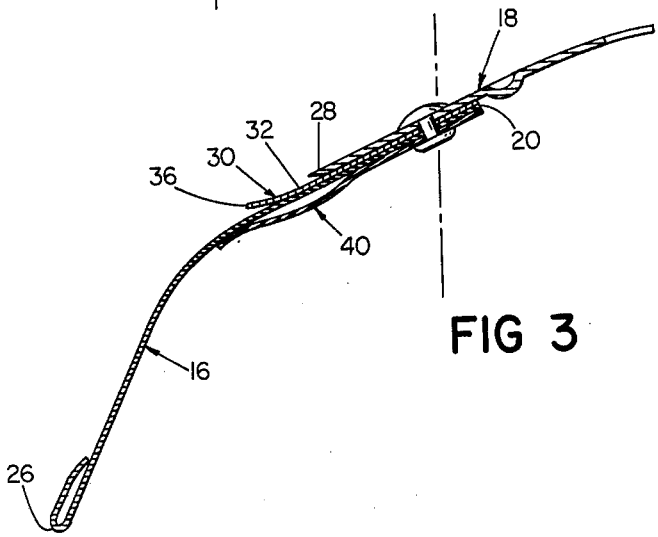
FIG 3
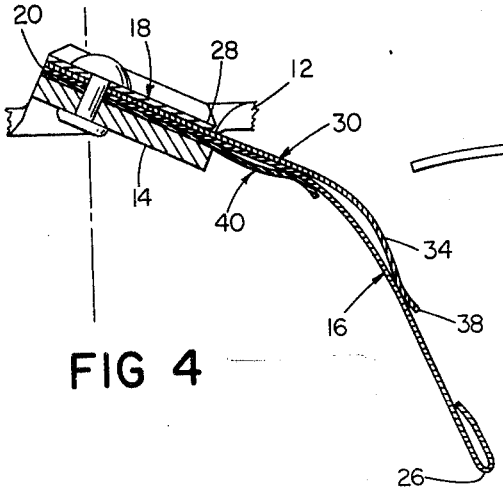
FIG 4
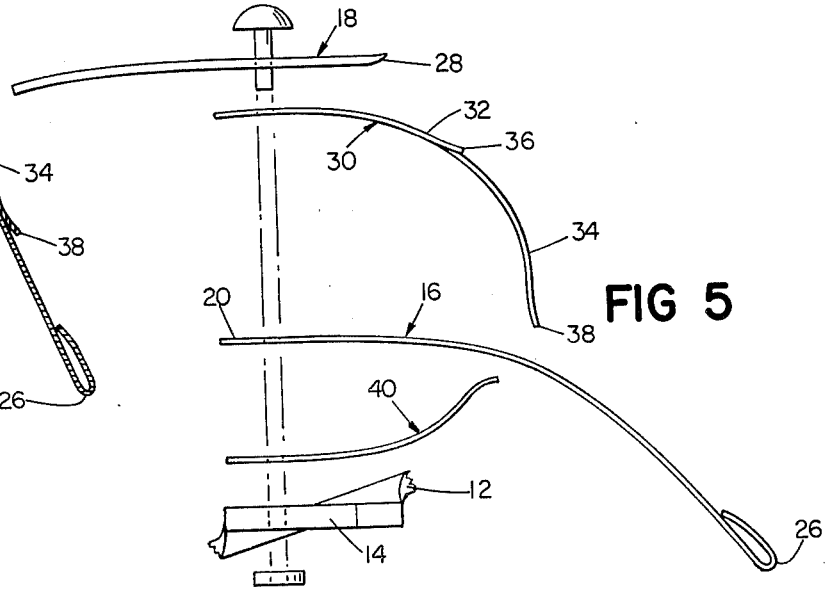
FIG 5

AUTOMOTIVE COOLING FAN WITH BIASED FLEXIBLE BLADES

This invention relates to automotive cooling fans and more particularly to fans having flexible blades which decamber with increasing rotational speed.

As such fans have been designed, the blades are relatively wide, to provide adequate air flow at low speed, but the blade material is extremely thin, e.g., 0.015 inch, to permit rapid deflection of the blades at higher speeds to minimize power consumption and noise when air flow requirements are met in large measure by vehicle motion. Unfortunately, the natural frequency of such blades sometimes falls close to or within the firing frequency range of an engine at idle resulting in blade vibration of substantial amplitude. Under some circumstances this vibration can lead to fatigue and premature failure of the fan blades, particularly at the root of the blade.

The vibration problem can be overcome by the use of heavier blade material and/or by reducing the blade width to increase the blade natural frequency. This expedient, however, results in a sacrifice of desirable blade deflection characteristics at high speed in a flexible bladed fan.

Prestressing the fan blade with a biasing member has also been suggested, as in U.S. Pat. Nos. 3,679,321 and 4,037,987, each of which employs a biasing member extending along the radial length of one side of the blade. As indicated in the latter patent, the blade natural frequency may thus be raised from 40–42 Hz. to about 48–50 Hz. which corresponds to the firing frequency of a V-8 engine at 750 r.p.m., i.e., above the normal idle speed of the engine. It has been found, however, that a natural frequency of 50 Hz. may not be sufficiently high to avoid problems, especially since engine calibrations, including spark advance settings, may be adjusted for satisfactory engine performance. Such adjustments are often made in the field.

It is thus a principal object of this invention to increase the natural frequency of flexible bladed fans to minimize resonance at typical engine idle speeds which may lead to failure. It is a further object of the invention to increase the natural frequency of the blades to a level substantially above the engine firing frequency to avoid resonance problems even when engine calibrations are changed. Yet a further object of the invention is to substantially increase the blade natural frequency without significant sacrifice of the desirable blade deflection characteristics of the flexible bladed fan.

In general, the invention features an automotive cooling fan having radially extending flexible blades connected to radial arms. The blades extend transversely behind the arms and are curved in a downstream direction. Flexible resilient biasing means are provided on the upstream sides of the blades biasing the blades in a downstream direction. The outer portions of the biasing means extend a first limited distance behind the arms to engage the radially outer portions of the blades, and the root portions of the biasing means extend a second and greater distance behind the arms to engage the root portions of the blades.

In the preferred embodiment of the root portions of the biasing means extend behind the arms a distance at least 50% of the blade width behind the arm and apply a greater biasing force to the blades than the outer portions of the biasing means. Second biasing means are provided on the downstream sides of the blades engaging the blades between the root and outer portions of the first biasing means.

Other objects, features and advantages of this invention will be apparent to those skilled in the art from the following detailed description of a preferred embodiment thereof taken together with the accompanying drawings, in which:

FIG. 1 is a fragmentary plan view of the upstream side of a fan made according to the invention;

FIG. 2 is a plan view of the downstream side of a fan blade assembly of the fan illustrated in FIG. 1;

FIG. 3 is an enlarged sectional view taken along the line 3—3 of FIG. 1;

FIG. 4 is an enlarged sectional view taken along the line 4—4 of FIG. 1; and

FIG. 5 is an enlarged, exploded, end view illustrating the components of a blade assembly of the fan shown in FIG. 1.

FIG. 1 illustrates a flexible bladed fan 10. In general the fan comprises a spider having a central planar hub 12 and a plurality of arms 14 radially extending from and integral with the hub 12. The arms 14 are twisted adjacent the hub 12 (see FIG. 4) and extend outwardly therefrom at an angle (e.g., 25°) to the plane of rotation.

The fan blade assemblies each comprise an arm 14, a fan blade 16 connected on the upstream side (defined by the direction of airflow) of the arm 14, and an overlying reinforcement member 18 connected to the arm 14 and blade 16 on the upstream side of the blade 16. Blade 16 is connected to arm 14 at the blade leading portion 20 (defined by the direction of fan rotation) and extends radially from a root portion 22, adjacent hub 12, outwardly to blade tip 24. Blade 16 extends transversely from leading portion 20, behind arm 14, to blade trailing edge 26, which is weighted in accordance with U.S. Pat. No. 3,594,098, and blade 16 is curved in a generally downstream direction behind arm 14, presenting a convex surface on the upstream side and a concave surface on the downstream side of the blade 16. The reinforcement member 18 extends radially along the blade leading portion 20 and extends transversely forward of the arm 14, defining an extended airfoil surface in accordance with U.S. Pat. No. 3,639,078. The trailing edge 28 of member 18 extends radially at or slightly behind arm 14 and is curved for stress relief purposes upstream away from blade 16. The spider, comprising hub 12 and arms 14, and the reinforcement member 18 are made of relatively rigid steel (SAE 950 AK, the spider being about 0.185 inch thick and member 18 being about 0.049 inch thick). Blade 16 is made of a flexible, resilient stainless steel (AISI 301, about 0.015 inch thick). Fans of the general construction described above are used widely in automotive cooling systems.

To achieve the purposes of the present invention, biasing means are provided to bias the blade 16. An upstream biasing member 30, of the same flexible resilient material as blade 16, is connected to the blade assembly between blade 16 and reinforcement member 18, best shown in FIGS. 3 and 4. Upstream biasing member 30 extends radially along the blade leading portion 20 from the root 22 to the tip 24 of the blade. Upstream member 30 extends transversely a limited distance behind arm 14 and is preformed to curve in a downstream direction on a smaller radius than the radius of curvature of blade 16, best shown in FIG. 5, to engage the blade 16 between arm 14 and the blade trailing edge 24 and to bias the blade in a downstream direction. The radially outer portion 32 of upstream member 30 extends behind arm 14 only a short distance and biases the blade 16 adjacent its leading portion. The root portion 34 of member 30, however, extends a substantial distance behind arm 14, e.g., more than 50% of the blade width behind the arm 14 in the illustrated embodiment, biasing the blade root portion 22 in a downstream direction with a greater biasing force than is applied by the outer portion of member 30. The trailing edges 36,38 of the outer and root portions 32,34 of member 30 are curved away from blade 16.

A biasing member 40, best shown in FIGS. 2, 3, and 4, is also provided on the downstream side of blade 16. The downstream biasing member 40, like member 30, is also made of the same flexible resilient material as blade 16 and is connected to the blade assembly between blade 16 and arm 14. Downstream member 40 extends radially along the blade leading portion 20 from root 22 adjacent tip 24 and extends transversely behind arm 14 to contact and bias blade 16 between trailing edges 36,38 of the root and outer portions 32,34 of upstream member 30. Member 40 is performed, as shown in FIG. 5, to have a curvature in a generally upstream direction to engage and bias the blade 16 in an upstream direction.

When the components of the blade assembly are joined, the root portion 34 of the biasing member 30 advantageously will cause the blade root portion 22 to lie at a greater angle to the plane of rotation than the blade outer portion 24. This provides an improved airfoil configuration leading to greater fan efficiency than a fan having all portions of a blade at a uniform angle to the plane of rotation. Since the outer blade portion 24 is not biased as close to the trailing edge 26 as the blade root portion 22, this advantageous shape is maintained as blade 16 decambers as the fan is operated at increasing rotational speeds. The lighter biasing force of the outer portion 32 of upstream member 30 combined with its position close to arm 14 and the engagement of downstream member 40 behind portion 24, provide a vibration dampening effect without significantly affecting the blade deflection characteristics.

Most importantly, the prestressing of the root portion 22 of the blade significantly reduces vibration of the blade, increasing the blade natural frequency and reducing vibration amplitude. Utilizing biasing members 30 and 40 as illustrated, it has been found possible to increase the natural frequency of a blade, as above described, to at least 60 Hz. and to reduce the amplitude of vibration at resonance to as little as 0.20 inch. Since a frequency of 60 Hz. corresponds to the firing frequency of a V-8 engine at about 900 r.p.m., the natural frequency of the blade is well above normal engine idle speeds and normally encounters resonant conditions only as a transient phenomenon even when engine calibrations are changed from design standards. Thus, it is possible to employ thin blade material having desirable deflection characteristics while minimizing resonant conditions and the possibility of blade failure.

Other embodiments of this invention will occur to those skilled in the art which are within the scope of the following claims.

What is claimed is:

1. An automotive cooling fan comprising a hub and a plurality of fan blade assemblies, each assembly comprising: an arm extending radially outwardly from said hub, and a flexible, resilient blade connected to said arm, said blade extending radially from a root portion adjacent said hub to a tip portion remote from said hub and extending transversely from a leading portion adjacent said arm to a trailing edge, relative to the direction of fan rotation, said arm, and said blade curved between said leading portion and said trailing edge presenting a convex surface on the upstream side, defined by the direction of airflow, and a concave surface on the downstream side of said blade, said blade adapted to decamber in an upstream direction with increasing rotational speed, characterized in that said assembly also comprises:

a flexible, resilient biasing member connected to said arm on the upstream side of said blade; said biasing member curved in a downstream direction on a smaller radius than that of said blade, contacting said blade behind said arm and biasing said blade in a downstream direction when said fan is stationary; said biasing member comprising a root portion overlying said blade root portion of an outer portion extending radially outwardly from said biasing member root portion; said biasing member outer portion contacting said blade along a line generally radially extending outwardly from said root portion at a first limited distance behind said arm and said biasing member root portion contacting said blade root portion at a second limited distance behind said arm greater than said first distance.

2. The fan claimed in claim 1 further characterized in that said second distance is at least 50% of the width of said blade behind said arm.

3. The fam claimed in claim 1 further characterized in that said fan blade assembly also comprises a flexible, resilient downstream biasing member connected to said arm and extending radially along the downstream side of the blade leading portion from the root to the tip portions of said blade, said downstream biasing member extending transversely from said leading portion a limited distance toward said trailing edge engaging said blade behind said arm and between said leading portion and said trailing edge and biasing said blade in an upstream direction.

4. The fan claimed in claim 3 further characterized in that said downstream biasing member extends transversely, contacts and biases said blade at a third limited distance between said first and second distances.

5. The fan claimed in claim 4 further characterized in that said second distance is at least 50% of the width of said blade behind said arm.

6. An automotive cooling fan comprising a plurality of radially extending flexible resilient blades connected to radially extending arms, said blades extending transversely from leading portions adjacent said arms to trailing edges behind said arms and curved therebetween to present a convex surface on the upstream side and a concave surface on the downstream side of said blades, characterized in that flexible resilient first biasing means are provided on the upstream sides of said blades engaging and biasing said blades in a downstream direction, said biasing means engaging the radially inner root portions of said blades behind said arms at a position at least 50% of the blade width behind said arms and engaging the radially outer portions of said blades along a line extending radially behind said arms at a distance therebehind less than the distance behind said arms at which root portions of said blades are engaged and said biasing means engaging said root portions of said blades with a greater biasing force than said outer portions of said blades.

7. The fan claimed in claim 6 further characterized in that second biasing means are provided on the downstream sides of said blades engaging and biasing said blades in an upstream direction, said second biasing means engaging said blades radially therealong behind said arms between the points of engagement with said blades of said first biasing means.

* * * * *

UNITED STATES PATENT AND TRADEMARK OFFICE

CERTIFICATE OF CORRECTION

PATENT NO. : 4,147,471

DATED : April 3, 1979

INVENTOR(S) : Herbert N. Charles

It is certified that error appears in the above-identified patent and that said Letters Patent are hereby corrected as shown below:

In Abstract, line 3, before "blades", "th" should be --the--.

Col. 1, line 64, "In the preferred", should be --In a preferred--.

Col. 3, line 20, "performed" should be --preformed--.

Signed and Sealed this

Thirty-first Day of July 1979

[SEAL]

Attest:

Attesting Officer

LUTRELLE F. PARKER

Acting Commissioner of Patents and Trademarks